US008393616B2

(12) United States Patent
Kubota et al.

(10) Patent No.: US 8,393,616 B2
(45) Date of Patent: Mar. 12, 2013

(54) SHEET COLLECTING APPARATUS AND IMAGE FORMATION SYSTEM PROVIDED WITH THE APPARATUS

(75) Inventors: Ichitaro Kubota, Kofu (JP); Tsukasa Kondo, Kofu (JP)

(73) Assignee: Nisca Corporation, Minamikoma-gun, Yamanashi-ken (JP)

( * ) Notice: Subject to any disclaimer, the term of this patent is extended or adjusted under 35 U.S.C. 154(b) by 143 days.

(21) Appl. No.: 12/801,490

(22) Filed: Jun. 11, 2010

(65) Prior Publication Data

US 2011/0049790 A1 Mar. 3, 2011

(30) Foreign Application Priority Data

Aug. 31, 2009 (JP) ..... 2009-200200

(51) Int. Cl.
*B65H 83/00* (2006.01)
*B65H 31/26* (2006.01)

(52) U.S. Cl. ..... 271/220; 271/3.03; 270/58.07

(58) Field of Classification Search ..... 271/220, 271/3.03, 303, 223–224; 270/58.07, 58.08, 270/58.09, 58.12, 58.17, 58.27
See application file for complete search history.

(56) References Cited

U.S. PATENT DOCUMENTS 5,083,761 A * 1/1992 Johdai et al. ..... 271/3.02
5,294,107 A * 3/1994 Allmendinger et al. ..... 271/220
6,561,504 B2 * 5/2003 Mlejnek et al. ..... 270/58.12
6,644,654 B1 * 11/2003 Mao ..... 271/220
7,697,883 B2 * 4/2010 Ogata et al. ..... 399/405
7,922,165 B2 * 4/2011 Kamiya ..... 270/58.17
7,980,544 B2 * 7/2011 Baba et al. ..... 270/58.11
2007/0057442 A1 * 3/2007 Terao et al. ..... 271/207
2009/0014946 A1 * 1/2009 Nagura et al. ..... 271/220
2009/0127764 A1 * 5/2009 Kamiya ..... 270/58.07
2009/0184454 A1 * 7/2009 Takai et al. ..... 270/58.08
2010/0096801 A1 * 4/2010 Yanagida ..... 271/220

FOREIGN PATENT DOCUMENTS

JP H09-118468 5/1997
JP 2006-008384 1/2006
JP 2008-297060 12/2008

* cited by examiner

*Primary Examiner* — Patrick Cicchino
(74) *Attorney, Agent, or Firm* — Manabu Kanesaka

(57) ABSTRACT

A sheet collecting apparatus includes a sheet discharge outlet for sequentially carrying out a sheet, a sheet collecting device to load and store the sheet from the sheet discharge outlet, a stopper device for regulating a front end position of the sheet loaded on the sheet collecting device, a stopper driving device for shifting a position of the stopper device, and a carry-in guide member for guiding the sheet from the sheet discharge outlet onto an uppermost sheet collected on the sheet collecting device. The carry-in guide member includes a pivot point, a slide-contact guide surface that swings on the pivot point corresponding to a load amount of the sheet collecting device to guide a sheet front end fed from the sheet discharge outlet onto the uppermost sheet, and a sheet pressing portion continued to the slide-contact guide surface and pressing the uppermost sheet on the sheet collecting device.

7 Claims, 9 Drawing Sheets

SHEET COLLECTING APPARATUS AND IMAGE FORMATION SYSTEM PROVIDED WITH THE APPARATUS

BACKGROUND OF THE INVENTION

The present invention relates to a sheet collecting apparatus for collecting and collating sheets carried out of an image formation apparatus such as a copier and printer, and more particularly, to improvements in a sheet collation collection mechanism.

Generally, a collecting apparatus for collating sheets carried out of an image formation apparatus, etc. is widely used as a post-processing apparatus, for example. Then, in this structure, a level difference is formed on the downstream side of a sheet discharge outlet to provide a collection tray, and a sheet is carried out to above the tray by a sheet discharge roller of the sheet discharge outlet, and is thereby piled and stored upward sequentially.

For example, an apparatus is disclosed in Japanese Unexamined Patent Publication No. 2006-008384 (Patent Document 1) in which sheets with images formed by an image formation apparatus are collated and collected on a processing tray, and this bunch of sheets is stapled in the center, and then folded in a magazine finish. In the Document, a sheet from the image formation apparatus is carried into inside a path disposed in the vertical direction, a sheet discharge roller is disposed in the path, a level difference is formed on the downstream side of the roller, and a collection tray is disposed therein. Then, disposed further are a stapling unit for stitching a bunch of sheets collected on the collection tray and a folding unit for folding in magazine form.

In such a sheet collation apparatus, consideration must be given to maintain the page order between a sheet that is carried in from the sheet discharge outlet and already collected sheets. This is because when the rear end of the prior sheet is curled and raised in carrying a subsequent sheet onto collected prior sheets from the sheet discharge outlet, the subsequent sheet sinks below the prior sheet, and the pages get out of order.

Therefore, not shown as a Cited Document, such a sheet discharge mechanism has conventionally been used frequently that a sufficient level difference is formed between the sheet discharge outlet and the collection tray, and that even when the rear end of the collected prior sheet is curled upward, the subsequent sheet is caused to enter from above and dropped. In such a sheet discharge structure, since a large level difference is provided between the sheet discharge outlet and the tray, there is a problem that the apparatus becomes large in size.

Then, in the apparatus described in Patent Document 1, the collection tray is inclined in the direction in which the sheet from the sheet discharge outlet is curled so as to prevent the subsequent sheet from breaking in. The page order is reserved by thus curling the sheet in the opposite direction to the curl resulting in incorrect collating, but the pages may get out of order due to the extent of curl of the collected prior sheet or curl of the front end of the carry-in sheet.

Further, in an apparatus described in Japanese Unexamined Patent Publication No. H09-118468 (Patent Document 2), a guide member rotating in paddle form is provided between the sheet discharge outlet and the collection tray, and the page order is reserved by rotating the guide member whenever a sheet enters from the sheet discharge outlet. In other words, the mechanism is proposed that when the sheet front end enters from the sheet discharge outlet, the guide member is positioned above the piled sheets, guides carry-in of the sheet, and after the sheet is carried in, turns to return onto the uppermost sheet.

Similarly, in an apparatus described in Japanese Unexamined Patent Publication No. 2008-297060 (Patent Document 3), a turning guide member is provided between the sheet discharge outlet and the collection tray, and is turned whenever a sheet enters. Further, not shown as a Cited Document, to resolve out of page order as described above, another apparatus is known where a sheet that is carried in the collection tray is switched back, the sheet rear end is backed toward the back side of the sheet discharge outlet, and the page order is thereby reserved.

In the sheet collation collection apparatuses as described above, there is the problem that the pages get out of order by a carry-in sheet sinking in between collected sheets when the sheet that is carried out of the sheet discharge outlet is loaded and stored. Therefore, conventionally, a level difference (drop) formed between the sheet discharge outlet and the collection tray is formed to the extent that the front end of the carried-out sheet does not reach the rear end of collected sheets. Therefore, since a drop of several tens of centimeters is required as a level difference between the sheet discharge outlet and the tray on the downstream side of the outlet, upsizing of the apparatus is inevitable.

Further, to miniaturize the apparatus, it is attempted to dispose the paddle-shape guide member in the rear end portion of the collection tray, but speedup of the apparatus is significantly affected by turning the guide member 180 degrees or 360 degrees at intervals of sheets that are sequentially carried out.

Furthermore, similarly, it is proposed to switch back the sheet that is carried in the collection tray to back the sheet rear end, but moving back and forth every time the sheet that is successively carried out becomes a problem in the high-speed processing.

Therefore, the inventor of the invention reached the idea of providing a guide member in stairs form at the sheet-discharge-outlet end of the collection tray, and using the guide member, preventing a sheet from rising, while guiding the front end of the carry-in sheet.

It is a main object of the invention to construct, in a simplified structure, a sheet collecting apparatus that is compact and that enables sheets successively carried out of the sheet discharge outlet to be reliably collated and collected in the order of pages.

BRIEF SUMMARY OF THE INVENTION

To attain the above-mentioned object, in the invention, a carry-in guide member is disposed between a sheet discharge outlet and sheet collecting means, and the carry-in guide member is comprised of a pivot point, a slide-contact guide surface that swings on the pivot point corresponding to a load amount of the sheet collecting means to guide a sheet front end fed from the sheet discharge outlet onto the uppermost sheet, and a sheet pressing portion that is continued to the slide-contact guide surface and that presses the uppermost sheet on the sheet collecting means. Concurrently therewith, the pivot point, slide-contact guide surface and sheet pressing portion are arranged in this order in the sheet discharge direction from the sheet discharge outlet.

Then, it is a feature that a stopper means for regulating a front end position of a sheet to be loaded on the sheet collecting means regulates a front end position of a sheet so that a contact point, where the front end of the sheet fed from the sheet discharge outlet first comes into contact with the slide-contact guide surface, is positioned on the downstream side in the sheet discharge direction from a rear end of a sheet loaded on the sheet collecting means.

The configuration will specifically be described below. Provided are a sheet discharge outlet (36) for carrying out a sheet, a sheet collecting means (35) disposed in a level difference formed on the downstream side of the sheet discharge outlet to load and store the sheet from the sheet discharge outlet, a stopper means (40) for regulating a front end position of the sheet to be loaded on the sheet collecting means, a stopper driving means (MS) for shifting a position of the stopper means corresponding to a sheet length, and a carry-in guide member (45) for guiding the sheet from the sheet discharge outlet onto the uppermost sheet collected on the sheet collecting means.

Then, the carry-in guide member (45) is comprised of a pivot point (45*x*), a slide-contact guide surface (45*a*) that swings on the pivot point corresponding to a load amount of the sheet collecting means to guide a sheet front end fed from the sheet discharge outlet onto the uppermost sheet, and a sheet pressing portion (45*b*) that is continued to the slide-contact guide surface and that presses the uppermost sheet on the sheet collecting means.

In the carry-in guide member, the pivot point, slide-contact guide surface and sheet pressing portion are arranged in this order in the sheet discharge direction from the sheet discharge outlet, and the stopper means regulates a front end position of a sheet so that a contact point, where the front end of the sheet fed from the sheet discharge outlet first comes into contact with the slide-contact guide surface, is positioned on the downstream side in the sheet discharge direction from a rear end of the sheet loaded on the sheet collecting means.

In the invention, it is configured that the carry-in guide member for guiding a sheet to the sheet collecting means from the sheet discharge outlet is comprised of the pivot point, the slide-contact guide surface that swings on the pivot point to guide a sheet front end onto the piled sheets, and the sheet pressing portion that presses the uppermost sheet of the piled sheets, the pivot point, slide-contact guide surface and sheet pressing portion are arranged in this order toward the sheet discharge direction, and that the contact point where the sheet front end from the sheet discharge outlet first comes into contact with the slide-contact guide surface is positioned on the downstream side in the sheet discharge direction from the rear end of the already loaded sheet. Therefore, the invention has the following effects.

A sheet from the sheet discharge outlet is reliably guided to the uppermost portion of already piled sheets by the carry-in guide. In other words, since in the carry-in guide are arranged the pivot point, slide-contact guide surface and sheet pressing portion in this order toward the sheet discharge direction, the carry-in guide guides the sheet fed to the sheet discharge outlet onto the uppermost sheet along the slide-contact guide surface in a state where the already stored piled sheets are pressed by the sheet pressing portion. Concurrently therewith, the slide-contact guide surface is formed so that the contact point with which the sheet front end first comes into contact is positioned on the downstream side in the sheet discharge direction from the rear end of the piled sheets, and therefore, the prior and subsequent pages do not get out of order.

Further, the carry-in guide member does not use a driving source such as a driving motor unlike the conventional paddle rotating body, and has the structure that the member is axially supported pivotably by the sheet collecting means simply from the sheet discharge outlet, and it is thereby possible to obtain a sheet collection mechanism rich in durability with little failure.

Furthermore, in the invention, by configuring so that the sheet pressing force of the carry-in guide can be adjusted to be high or low, for example, when an operator inputs the sheet thickness information and information such as a material indicating ease of curling occurrence, control can be performed to adjust the sheet pressing force by the carry-in guide member to be high or low based on the input information. For the high/low adjustment of the sheet pressing force in this case, for example, a biasing spring is installed in the carry-in guide member to enable the biasing spring to be engaged and released, and it is configured that the action of the biasing spring is controlled to engage or release.

DETAILED DESCRIPTION OF THE INVENTION

Configuration of a Sheet Collecting Apparatus

Figure 1:
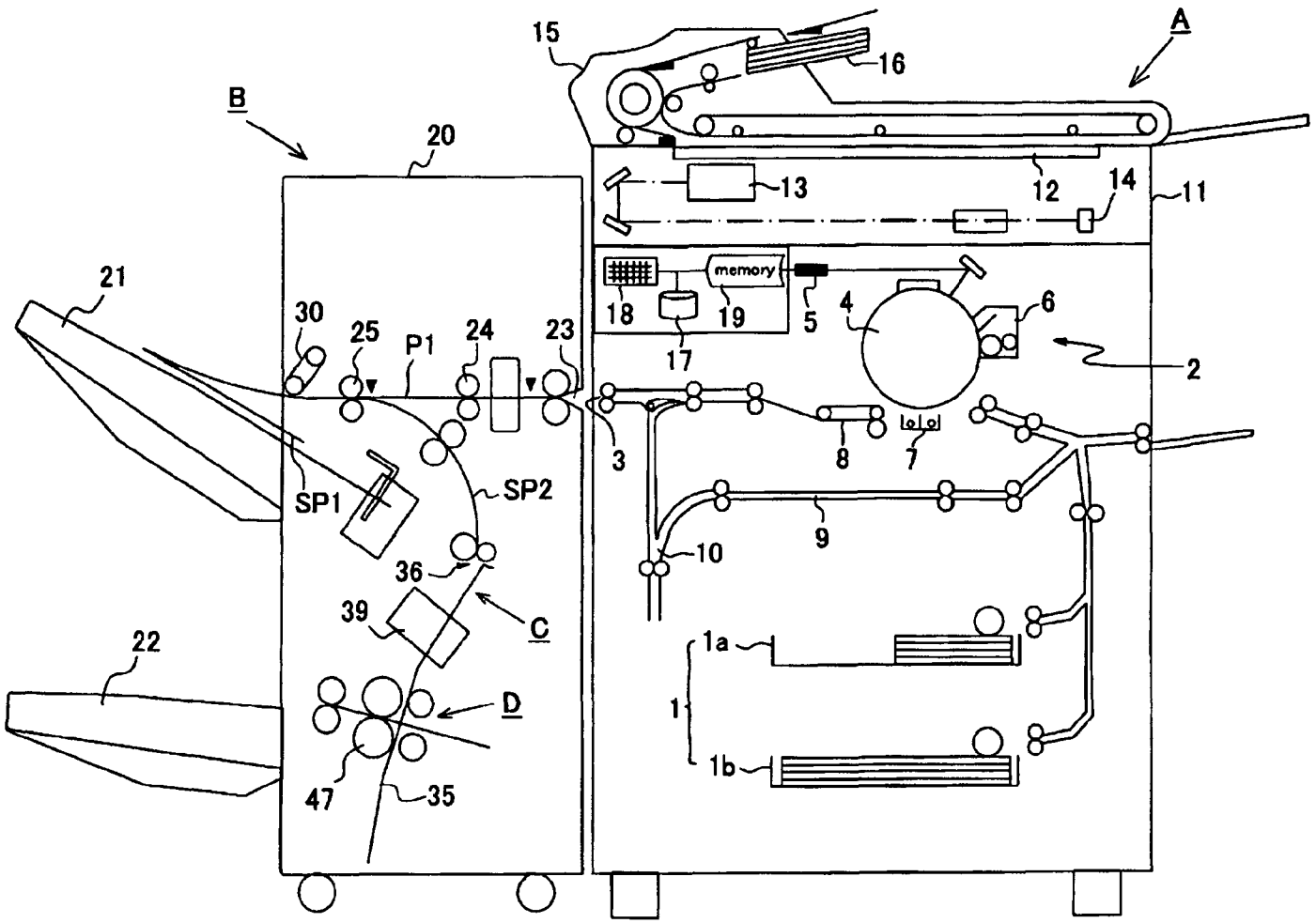
FIG. 1 is an explanatory view of the entire configuration of an image formation system according to the invention.

Described first is a basic configuration of a sheet collecting apparatus C according to the invention. In an image formation system as shown in FIG. 1, the sheet collecting apparatus C is built into a post-processing apparatus B attached to an image formation apparatus A as a unit.

Figure 2:
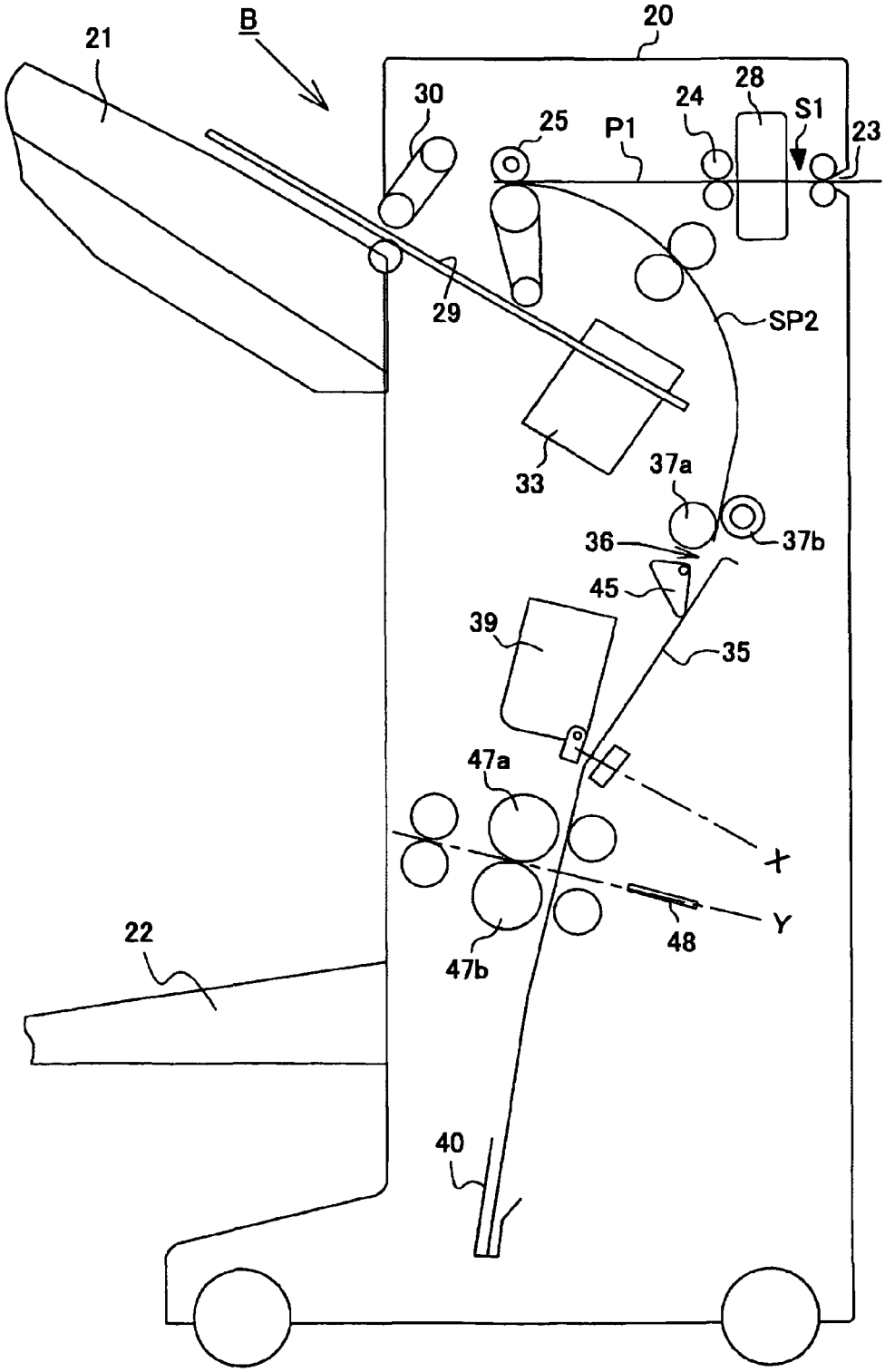
FIG. 2 is an entire explanatory view of a post-processing apparatus in the system of FIG. 1.
Figure 3:
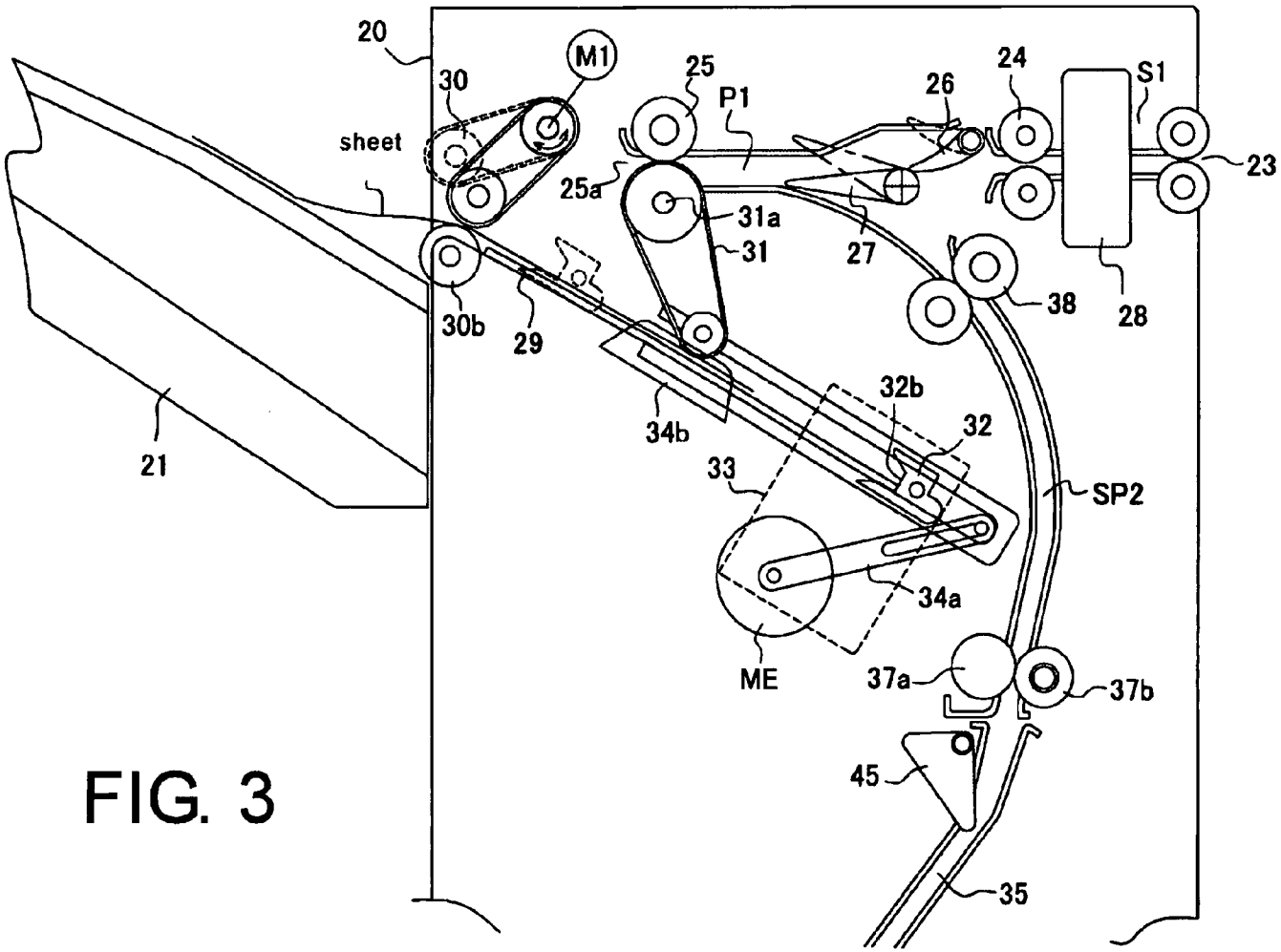
FIG. 3 is a specific explanatory view illustrating a switch-back transport path in the post-processing apparatus of FIG. 2.

FIG. 2 shows the entire configuration, FIG. 3 shows the specific configuration, and the sheet collecting apparatus C is provided with a sheet discharge path (second switch-back transport path, described later) SP2 for sequentially carrying out a sheet, a sheet discharge outlet 36 provided in the sheet discharge path SP2, and a sheet collecting means (collection tray) 35 provided juncturally on the downstream side of the sheet discharge outlet 36.

For example, the sheet discharge path SP2 is separated from a sheet carry-in path P1 coupled to a sheet discharge outlet 3 of the image formation apparatus A and is thus formed. Then, sheet discharge rollers 37*a*, 37*b* are disposed in the sheet discharge outlet 36, and are driven to rotate in the sheet discharge direction (leftward in FIG. 2) by a driving motor not shown.

The sheet collecting means 35 is comprised of a tray (hereinafter, referred to as a collection tray) for supporting piled sheets. Then, a level difference da is formed below the sheet discharge outlet 36, and it is configured that a sheet is dropped onto the tray from the sheet discharge outlet to be piled. The configuration of the sheet discharge portion is specifically shown in FIG. 7, and will be described below according to FIG. 7. The level difference da is set at an extent larger than the maximum load height db of sheets that can be stored on the collection tray (da>db).

Concurrently therewith, the level difference da is set so that a sheet front end Sx fed from the sheet discharge outlet 36 is in a position higher than the maximum load height db. In other words, the level difference da, the sheet maximum load height db and sheet carry-in height dc are set so that da>dc>db with reference to a sheet load surface 35*a* of the collection tray 35. In addition, in this case, the sheet carry-in height dc varies the height position according to properties (sheet thickness, sheet material and curling degree) of a sheet fed from the sheet discharge outlet 36. Therefore, the sheet carry-in height dc is set at dc>db under the carrying-out condition of a sheet nearest the sheet load surface.

In thus set sheet discharge outlet 36, a carry-in guide member 45 is disposed that guides the front end Sx of the fed sheet onto the uppermost sheet piled on the collection guide 35. The carry-in guide member 45 is comprised of a pivot point 45*x*, a slide-contact guide surface 45*a* that swings on the pivot point corresponding to a sheet load amount to guide the sheet front end Sx fed from the sheet discharge outlet 36 onto the uppermost sheet, and a sheet pressing portion 45*b* that is continued to the guide surface and that presses the uppermost sheet piled on the collection tray.

In other words, in between the sheet discharge outlet 36 and the uppermost sheet on the tray is disposed the guide member of the appropriate shape such as the shape of a plate or a block having the slide-contact guide surface 45*a* and pressing surface 45*b* continued to the surface 45*a*. Then, this member is axially supported on the pivot point 45*x* to be pivotable so as to move up and down in the sheet load direction. The slide-contact guide surface 45*a* is formed of a guide surface inclined to guide the sheet front end fed to the sheet discharge outlet 36 onto the uppermost sheet on the tray. This guide surface may be formed in the shape of a straight line as shown in FIG. 7, or curved in the shape of a recess.

The slide-contact guide surface 45*a* thus disposed between the sheet discharge outlet 36 and the uppermost sheet is disposed in a position where the sheet carry-in height dc as described previously agrees with a height position P of an initial contact point u (see FIG. 7) with which the sheet front end Sx from the sheet discharge outlet 36 first comes into contact. By this means, the shape and placement (distance from the sheet discharge outlet) of the guide surface are set so that the sheet front end Sx from the sheet discharge outlet 36 comes into contact with the slide-contact guide surface 45*a* above the maximum load height db (dc>db).

Meanwhile, in the above-mentioned collection tray 35 is disposed a stopper means 40 for regulating the front end position (or rear end position) of the sheet. The stopper means 40 is configured to be able to travel to positions in the sheet discharge direction separately from the collection tray 35. The configuration will be described later. In FIG. 7, the collection tray 35 is provided with the stopper 40 for regulating the position of the sheet front end, not shown, and it is configured that the stopper regulates the position in the sheet discharge direction of the sheet rear end Sy dropping from the sheet discharge outlet 36.

Figure 7:
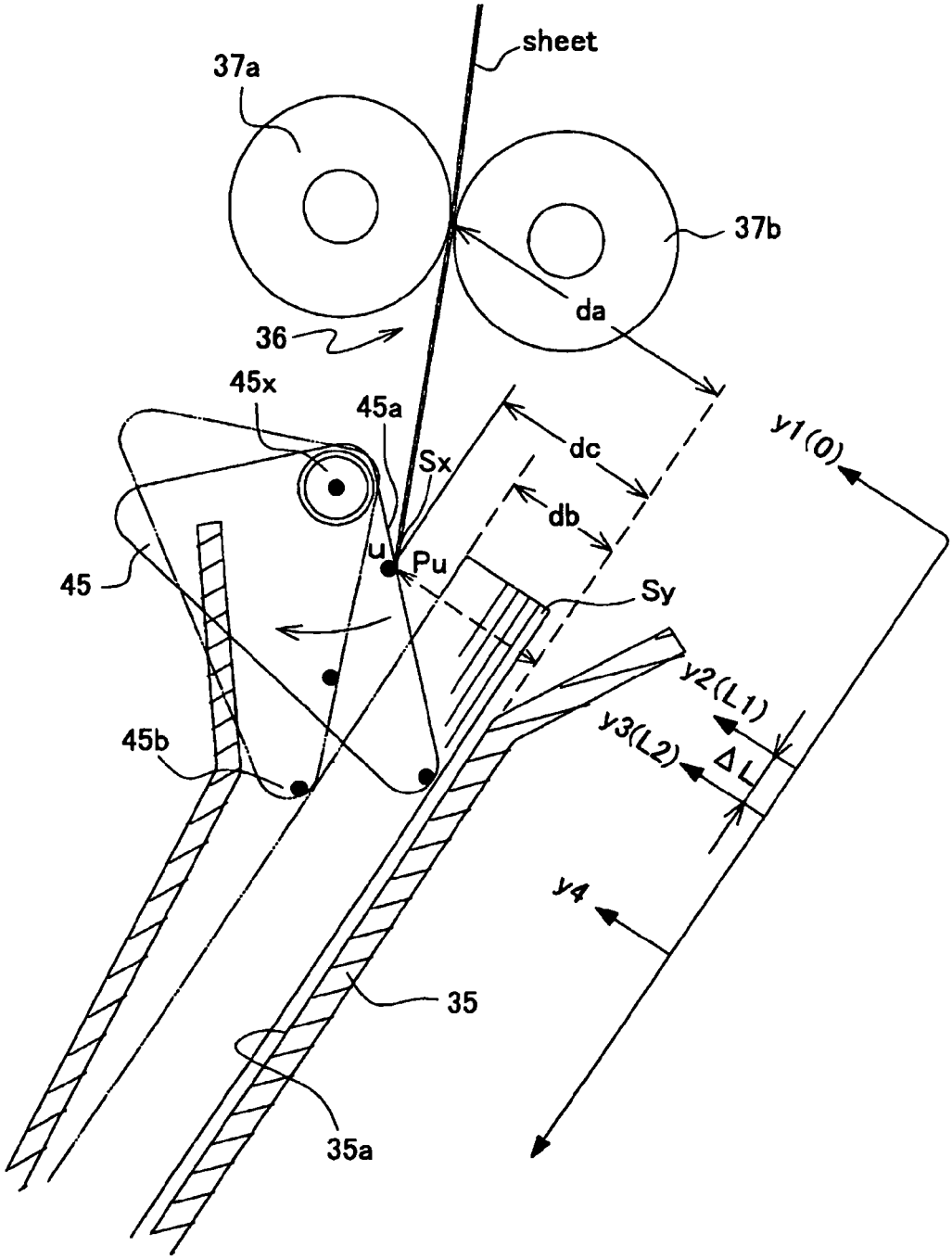
FIG. 7 is an explanatory view of a sheet carry-in mechanism of a sheet collecting portion in the apparatus of FIG. 2 and shows a configuration of a sheet discharge outlet.

Then, the stopper means 40 described later is configured to be able to travel to positions corresponding to the sheet size, and matches the sheet rear end Sy with a sheet rear end regulation position y2 as shown in FIG. 7. Then, the sheet rear end regulation position y2 is set at a position (y1=0, y2=L1, y2>y1) spaced a distance L1 on the downstream side in the sheet discharge direction from an immediately below position y1 of the sheet discharge outlet 36. Further, the sheet rear end regulation position y2 is set to be positioned on the sheet discharge outlet side from a sheet discharge direction position y3 of the initial contact point u where the sheet front end from the sheet discharge outlet 36 first comes into contact with the slide-contact guide surface 45*a* of the carry-in guide member 45.

This state will be described with reference to the immediately below position y1 of the sheet discharge outlet 36 based on FIG. 7. The sheet rear end regulation position y2 is set at a position spaced the distance L1 from the immediately below position y1, the sheet discharge direction position y3 of the initial contact point u is set at a position spaced a distance L2 from the position y1, and at this point, it is set that L2>L1. Then, the sheet rear end regulation position y2 is disposed on the upstream side in the sheet discharge direction from a sheet pressing position y4 of the pressing surface (sheet pressing portion) 45*b* described later.

In the above-mentioned carry-in guide member 45 is formed the pressing surface (sheet pressing portion) 45*b* continued to the slide-contact guide surface 45*a*. The pressing surface (sheet pressing portion; the same in the following) is comprised of a contact surface that comes into contact with the uppermost sheet on the collection tray, and swings on the pivot point 45*x* corresponding to a load amount of sheets on the tray. This pressing surface 45*b* presses the sheet to prevent the sheet on the collection tray from rising upward.

Then, the carry-in guide member 45 is provided with a biasing means 46 so that the pressing surface 45*b* always presses the uppermost sheet. The biasing means 46 adopts any one of methods of (1) configuring that the pressing surface always presses the uppermost sheet by own weight of the guide means, (2) biasing the guide member in a predetermined direction using a spring member, and (3) biasing the guide member in a predetermined direction using a weight member.

In (1) as described above, the pivot point 45*x* of the carry-in guide member 45 having the slide-contact guide surface 45*a* and pressing surface 45*b* is set at a position such that the barycenter induces rotation moment. This aspect is shown in FIG. 8B.

In (2) as described above, a biasing spring 45S is disposed in the carry-in guide member 45 having the slide-contact guide surface 45*a* and pressing surface 45*b*. As the biasing spring 45S, an elastic member such as a coil spring and blade spring is disposed between the carry-in guide member 45 and apparatus frame. FIG. 8C shows the aspect, where the a helical spring wound around the pivot point 45*x* of the carry-in guide member is locked in the apparatus frame (not shown in the figure), and the spring force always acts in the arrow direction shown in the figure.

Above-mentioned (3) is not shown, but a weight member (weight) is provided separately from the carry-in guide member, and the weight is installed in the guide member to produce rotation moment on the axis.

Figure 8A:
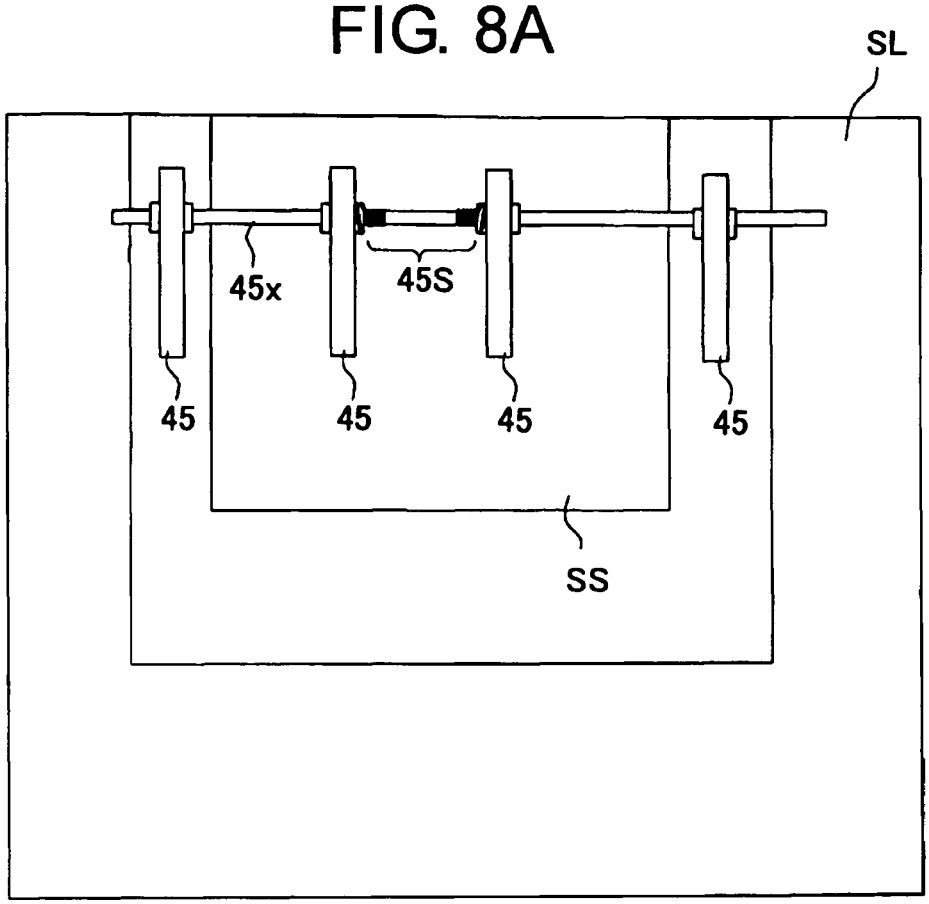
FIG. 8A is an explanatory view of the sheet carry-in mechanism of the sheet collecting portion in the apparatus of FIG. 2 and is an explanatory view of the planar structure.
Figure 8B:
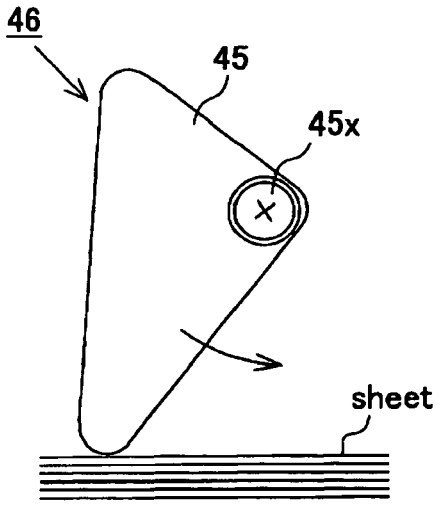
FIG. 8B is another explanatory view of the sheet carry-in mechanism of the sheet collecting portion in the apparatus of FIG. 2 and is a view illustrating a first carry-in guide.
Figure 8C:
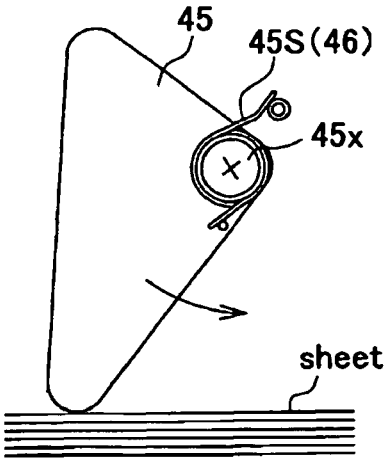
FIG. 8C is still another explanatory view of the sheet carry-in mechanism of the sheet collecting portion in the apparatus of FIG. 2 and is a view illustrating a second carry-in guide.

Then, as shown in FIG. 8A, the carry-in guide member 45 adopts either a method of providing a plurality of members 45 spaced a distance apart from one another in the direction orthogonal to the sheet discharge direction (the arrow direction in FIG. 8A) or a method of providing the member 45 so as to guide the entire sheet width direction. The member as shown in the figure shows the case that the member is formed of a plurality of guide members spaced a distance apart from one another in the sheet width direction.

In other words, a plurality of (four) carry-in guide members 45 is provided in the sheet width direction corresponding to the width size of a large-size sheet SL, and two central guide members are arranged to correspond to the width size of a small-size sheet SS. Then, two central guide members are provided with the biasing spring 45S to increase the pressing force of the pressing surface 45*b*.

Accordingly, as compared with the pressure of the guide members positioned at right and left in the figure, it is configured to increase the pressing force of the guide members positioned in the center. In addition, it is not always necessary to provide a plurality of carry-in guide members 45 in the sheet width direction, and the member 45 may be comprised of a plate-shaped member for guiding the entire width direction.

A different Embodiment of the carry-in guide member will be described below with reference to FIGS. 9A and 9B. The carry-in guide member 45 as described above is disposed between the sheet discharge outlet 36 and the uppermost sheet, always presses the uppermost sheet, and is configured to swing by the sheet front end carried in from the sheet discharge outlet 36 so as to carry the carry-in sheet onto the uppermost sheet.

Then, the pressing force of the pressing surface 45*b* is set by own weight of the guide member, spring force of the biasing spring, or action force of the weight member. With respect to the pressing force of the pressing surface 45*b*, it is possible to adjust the pressing force to increase or decrease corresponding to the properties such as "sheet thickness, properties (nerve), and degree of curling", of the transported sheet, or (2) adjust the pressing force to increase or decrease corresponding to timing of the sheet front end carried out of the sheet discharge outlet 36. The Embodiment will be described below.

Figure 9A:
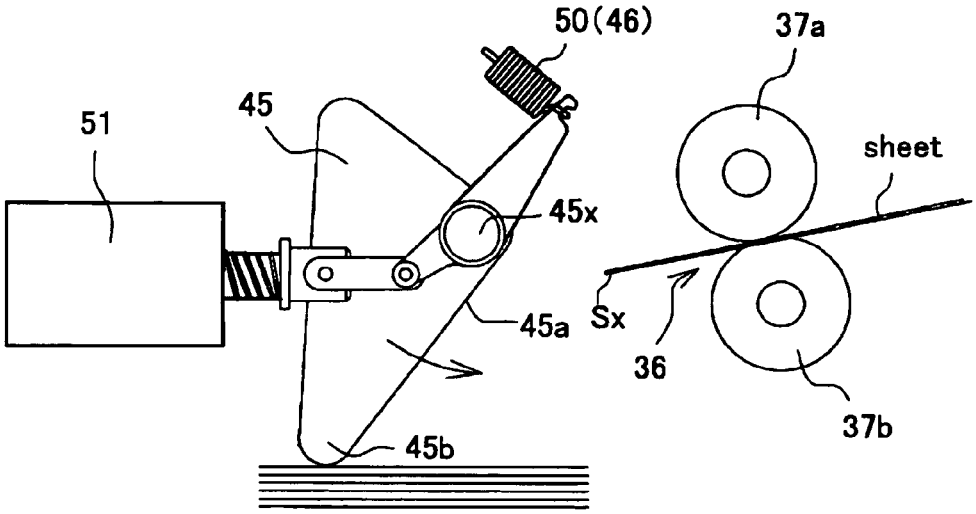
FIG. 9A illustrates a carry-in guide in the apparatus of FIG. 2, shows an Embodiment different from FIGS. 8A to 8C, and illustrates a pressing state.
Figure 9B:
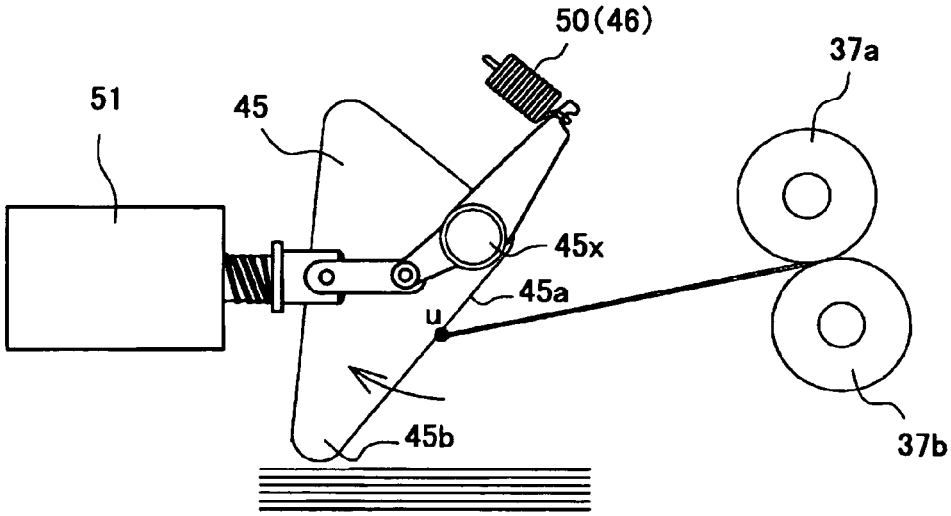
FIG. 9B illustrates the carry-in guide in the apparatus of FIG. 2, shows the Embodiment different from FIGS. 8A to 8C, and illustrates a pressing released state.

In FIGS. 9A and 9B, as in the member as described previously, the carry-in guide member 45 provided with the slide-contact guide surface 45*a* and pressing surface 45*b* is disposed pivotally on the pivot point 45*x*. Then, the carry-in guide member 45 is provided with a biasing spring 50 between the member and apparatus frame (not shown in the figure). Further, the carry-in guide member 45 is provided with a switching means (for example, operation solenoid) 51 for reducing the biasing force of the spring. With respect to the biasing spring 50 and switching means 51, the biasing spring 50 acts to increase the pressing force of the carry-in guide member 45, and the switching means 51 is provided to reduce the action force of the spring.

Then, the switching means 51 shown in the figure is comprised of an operation solenoid, and the spring force of the biasing spring 50 acts on the guide member when the solenoid is not energized, while not acting (or being reduced) when the solenoid is energized.

Accordingly, different operation modes are provided corresponding to the properties of sheets supplied to the sheet discharge outlet 36 from the image formation apparatus A or the like. For example, in a first mode set by an operator from a control panel 18, the pressing surface 45*b* presses the uppermost sheet by own weight of the carry-in guide member 45. Meanwhile, in a second mode that the sheet thickness is thin and that curling is apt to occur, the switching member 51 is operated to cause the spring force of the biasing spring 50 to act on the carry-in guide member 45.

In other words, in the first mode, the switching member 51 (control of applying power to the operation solenoid) is operated as shown in FIG. 9B. In the second mode, the switching member 51 (control of not applying power to the operation solenoid) is operated as shown in FIG. 9A.

Then, a plurality of carry-in guide members 45 is spaced a distance apart from one another in the direction orthogonal to the sheet discharge direction, a first group of the plurality of carry-in guide members 45 is provided with the biasing means 46 for adding the pressing force for the sheet pressing portion 45*b* to press the sheet on the sheet collection tray 35, and in the other second groups, the biasing member 46 for adding the pressing force for the sheet pressing portion 45*b* to press the sheet is provided so as to enable the member 46 to be switched between engagement and release. Then, the second groups are disposed on both sides of the first group.

Thin sheets with wide widths have characteristics that sheet opposite end portions particularly tend to buckle. Therefore, in this case, the sheets are pressed by own weight of the guide member 45. In curled nerve sheets, the opposite side end portions tend to float by curling as compared to the inner side (center), and in this case, the sheets are pressed by strong force. Thus, by adjusting under the pressing condition in accordance with the properties of the sheets, collection failure does not occur.

Action of the Carry-In Guide

The sheet carried out of the sheet discharge outlet 36 by the above-mentioned configuration drops onto the collection tray 35 and is stored. In the sheet stored within the tray, the front end is regulated in position by the stopper means 40, while the sheet rear end Sy is aligned with the sheet rear end regulation position y2 set under the sheet discharge outlet 36.

Figure 5:
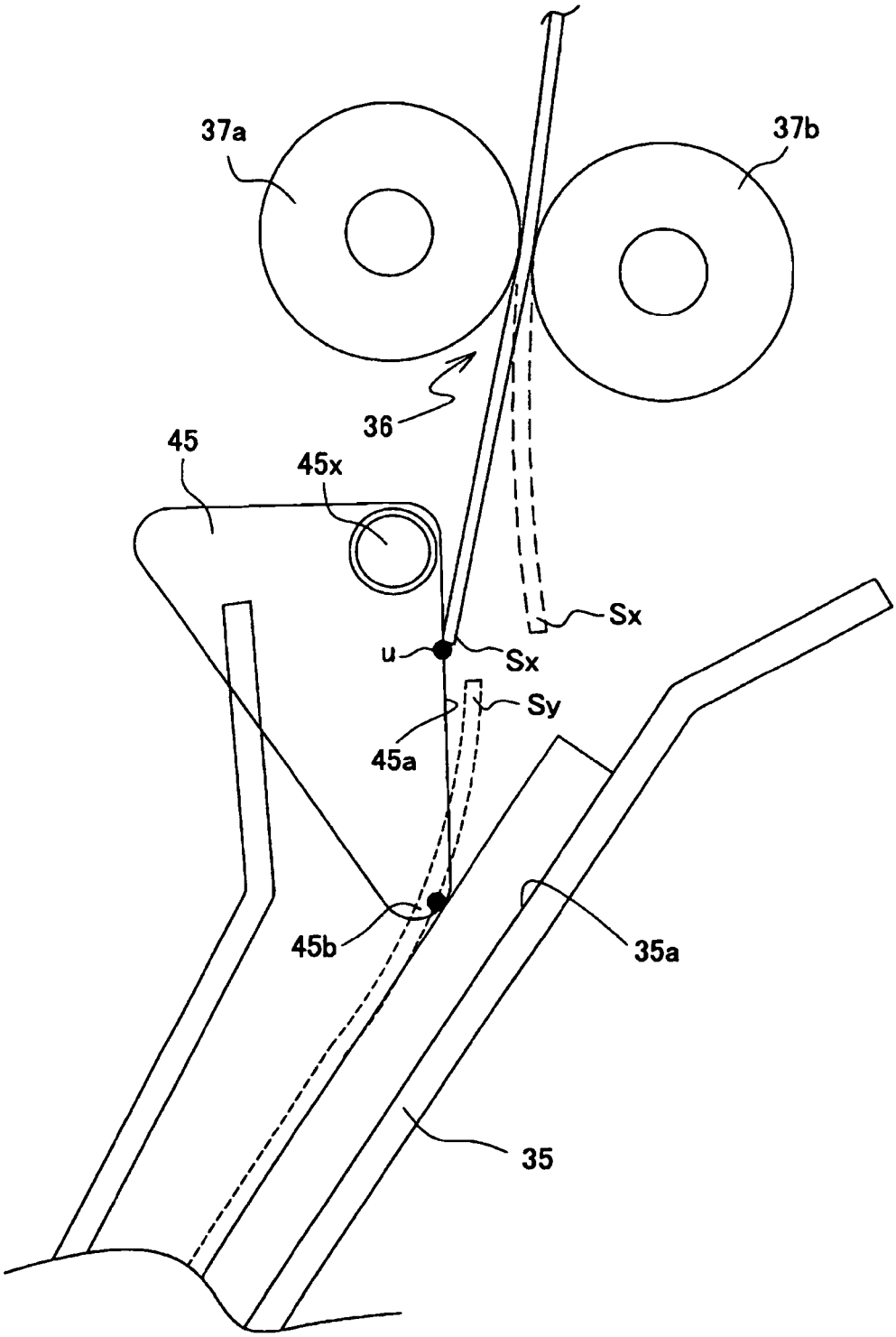
FIG. 5 is an explanatory view illustrating a configuration of a carry-in guide in the apparatus of FIG. 2.

Then, when the sheet front end Sx carried out of the sheet discharge outlet 36 is curled downward as shown by chain lines in FIG. 5 or the sheet rear end Sy piled on the collection tray 35 is curled upward as shown by chain lines in FIG. 5, the carry-in sheet may sink in between collected sheets. At this point, the sheet carry-in guide 45 acts as described below.

Figure 6A:
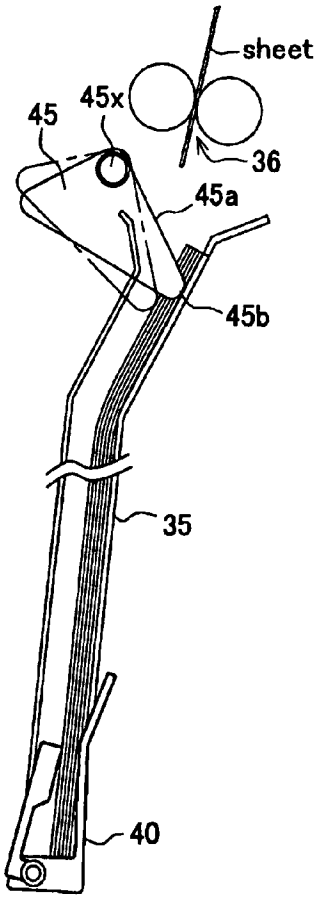
FIG. 6A is an explanatory view of post-processing operation on sheets in the apparatus of FIG. 2 and is a state view showing the initial state.

As shown in FIG. 6A, a sheet is fed to the sheet discharge outlet 36 of the sheet discharge path SP2 with prior sheets collected on the collection tray 35. The sheet is guided by the carry-in guide member 45 and piled on the collection tray 35. The carry-in guide member 45 swings on the pivot point 45*x* to the chain-line position in FIG. 6A corresponding to the load amount of the sheets. Then, when a subsequent sheet is fed to the sheet discharge path SP2, the front end Sx of the sheet first comes into contact with the carry-in guide member 45 in the initial contact point u. The initial contact point u is set at the height position (dc>db) above the maximum load height db on the collection tray, while the sheet discharge direction position y3 is set on the downstream side from the rear end regulation position y2 of the collected sheets. Under such conditions, the sheet front end does not sink into the end surface of the sheet piled on the collection tray from the sheet discharge outlet 36.

Figure 6B:
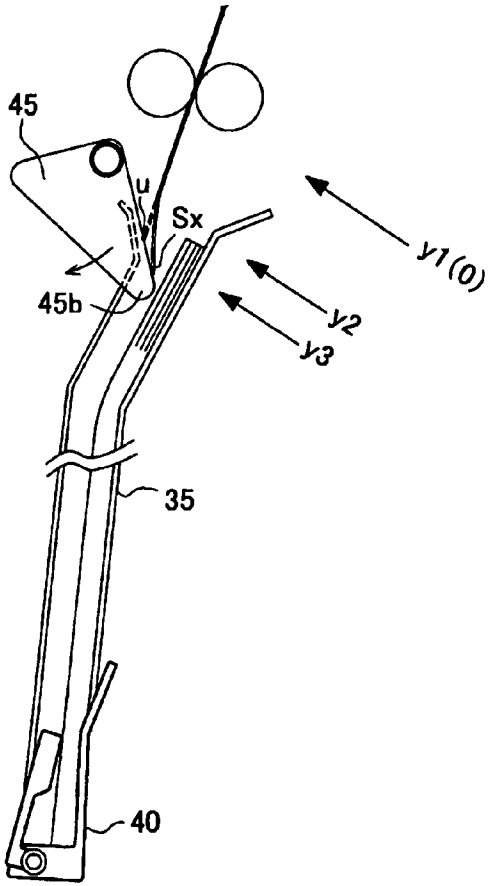
FIG. 6B is another explanatory view of the post-processing operation on sheets in the apparatus of FIG. 2 and is a state view where a sheet is carried in a collection tray.

Then, the sheet front end Sx from the sheet discharge outlet 36 comes into contact with the slide-contact guide surface 45*a* in the initial contact point u as shown in FIG. 6B, and is guided onto the uppermost sheet along the guide surface. Concurrently therewith, the carry-in guide member 45 is given the rotation force on the pivot point 45*x* from the carry-in sheet front end Sx, and swings in the arrow direction in FIG. 6B.

In addition, in the carry-in guide member 45, the height positions are set in the order of the pivot point 45*x*, slide-contact guide surface 45*a* and pressing surface 45*b*. Therefore, the rotation force (rotation moment) of the carry-in sheet front end Sx acting on the carry-in guide member 45 increases, as the sheet front end is brought closer to the uppermost sheet. The adverse effect is thereby prevented that the front end buckles and becomes entangled after the sheet front end Sx comes into contact with the slide-contact guide surface 45*a*.

Figure 6C:
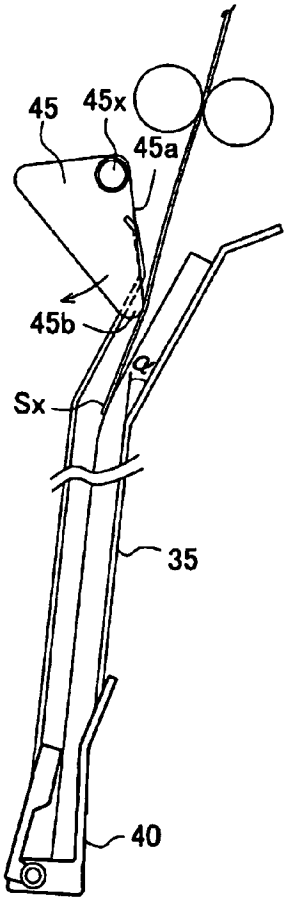
FIG. 6C is still another explanatory view of the post-processing operation on sheets in the apparatus of FIG. 2 and is a state view where the sheet is loaded on the collection tray.

Next, when the sheet front end Sx enters in between the uppermost sheet and the pressing surface 45*b* along the slide-contact guide surface 45*a*, the carry-in guide member 45 undergoes the maximum rotation force (since the distance between the pivot point 45*x* and the sheet front end is the maximum), and swings on the pivot point 45*x* in the arrow direction. This state is shown in FIG. 6C, and as can be seen from FIG. 6C, an inclined angle $\alpha$ is formed in the sheet load surface 35*a* of the collection tray 35 so that the carry-in guide member 45 reliably swings by the entering force (transport force) of the sheet front end.

Described next is the Embodiment of the carry-in guide member 45 described based on FIGS. 9A and 9B. The carry-in guide member 45 shown in the figures is configured so that the pressing force for the pressing surface 45*b* to press the sheet is adjustable to be high or low. In this case, control of the switching means 51 is required to switch between engagement and release of the biasing member 46 for adding the pressing force to the carry-in guide member 45.

Therefore, (1) when the pressing force is adjusted to increase or decrease corresponding to properties of the sheet as described previously, a control means (not shown in the figure) is configured as described below. For example, an operator inputs properties of the sheet in the control panel 18 of the apparatus. When the properties show that the sheet thickness is thin or the sheet tends to curl under the image formation conditions, the pressing force is increased (first operation mode), and in the other case, the pressing force is reduced (second operation mode).

Then, in the first operation mode, the switching means 51 (operation solenoid) is controlled to the state where the biasing means 46 acts the pressing force on the carry-in guide member 45 at timing at which the sheet is carried out to the sheet discharge outlet 36. Meanwhile, in the second operation mode, the switching means 51 (operation solenoid) is controlled to the state where the biasing means 46 does not act on the carry-in guide member 45.

Further, (2) when the pressing force is adjusted to increase or decrease corresponding to the timing of the sheet front end as described previously, for example, a sheet discharge sensor detects the front end of the sheet fed to the sheet discharge outlet 36. Then, with reference to this detection signal, the switching means 51 (operation solenoid) is controlled to the state where the biasing means 46 does not act on the carry-in guide member 45 before or after (including immediately before and immediately after the arrival) the timing at which the sheet front end Sx arrives at the initial contact point u of the slide-contact guide surface 45*a*.

By this means, until the sheet front end reaches the initial contact point u, the pressing surface 45*b* presses the collected sheets by strong force, and prevents the sheet from rising above the tray due to curling or the like. Then, at the predicted time the sheet front end arrives at the initial contact point u, the switching means 51 is operated. By this means, the carry-in guide member 45 is carried onto the uppermost sheet reliably by transport force of the sheet.

Image Formation System

Described next is the image formation system with the above-mentioned sheet collecting apparatus built therein. The image formation system as shown in FIG. 1 is comprised of the image formation apparatus A and the post-processing apparatus B, and the sheet collecting apparatus C is built into the post-processing apparatus B as a unit.

Configuration of the Image Formation Apparatus

In the image formation apparatus A as shown in FIG. 1, a sheet is fed to an image formation section 2 from a paper feed section 1, the image formation section 2 prints on the sheet, and the sheet is discharged from the main-body sheet discharge outlet 3. The paper feed section 1 stores a plurality of sizes of sheets in paper cassettes 1*a*, 1*b*, and separates the designated sheets on a sheet-by-sheet basis to feed to the image formation section 2.

For example, in the image formation section 2 are disposed an electrostatic drum 4, and a printing head (laser emitter) 5, development device 6, transfer charger 7 and fuser 8 disposed around the drum 4. An electrostatic latent image is formed on the electrostatic drum 4 using the laser emitter 5, the development device 6 adds toner to the image, the transfer charger 7 transfers the image onto the sheet, and the fuser 8 fuses and fixes the image.

The sheet with thus formed image is sequentially carried out of the sheet discharge outlet 3 of the image formation apparatus A. "9" shown in the figure denotes a circulation path, and is a path for two-side printing in which the sheet printed on the front side from the fuser 8 is reversed via a switch-back transport path 10, and is fed to the image formation section 2 again to print on the back side of the sheet. The sheet thus printed on both sides is reversed in the main-body switch-back path 10, and is carried out of the sheet discharge outlet 3.

"11" shown in the figure denotes an image reading apparatus, where an original sheet set on a platen 12 is scanned by a scan unit 13, and light is projected on a photoelectric converter 14 via a lens optical series. Then, data subjected to photoelectric conversion in the photoelectric converter 14 is subjected to digital processing, for example, in an image processing section and is transferred to a data storage section (hard disk, etc.) 17 of the image formation apparatus A. The image formation apparatus A reads the image data from the data storage section 17, and outputs an image signal to the laser emitter 5 as described previously. Further, "15" shown in the figure denotes a document feeder apparatus, and is a feeder apparatus for feeding original sheets stored in a stacker 16 to the platen 12 of the image reading apparatus 11.

The image formation apparatus A with the aforementioned configuration is provided with a control section (controller) not shown, and from the control panel 18 are set image formation conditions such as, for example, sheet size designation and color/monochrome printing designation, and print-out conditions such as the number-of-copies designation, one-side/two-side printing designation and scaling printing designation.

Meanwhile, it is configured in the image formation apparatus A that the data storage section 17 stores the image data read in the image reading apparatus 11 or image data transferred from the external network, and transfers the image data to buffer memory 19, and that the buffer memory 19 outputs a data signal to the laser emitter 5 sequentially.

Configuration of the Post-Processing Apparatus

Described next is the post-processing apparatus B coupled to the aforementioned image formation apparatus A. The post-processing apparatus B receives a sheet with the image formed thereon from the sheet discharge outlet 3 of the image formation apparatus A, and is configured to (1) store the sheet in a first sheet discharge tray 21 without performing any post-processing on the sheet ("print-out mode" as described later), (2) collate sheets from the sheet discharge outlet 3 in bunch form to staple, and then store the sheets in the first sheet discharge tray 21 ("stapling mode" as described later), or (3) collate sheets from the sheet discharge outlet 3 in bunch form, then fold the sheets in book form, and store the sheets in a second discharge tray 22 ("sheet bunch folding mode" as described later).

Therefore, as shown in FIG. 2, the post-processing apparatus B is provided with the first sheet discharge tray 21 and second sheet discharge tray 22 in a casing 20. Further, the apparatus B is provided with a sheet carry-in path P1 having a carry-in entrance 23 continued to the sheet discharge outlet 3 of the image formation apparatus A. The sheet carry-in path P1 is formed of a straight-line path in the substantially horizontal direction in the casing 20.

Then, provided are a first switch-back transport path SP1 and second switch-back transport path SP2 that separate from the sheet carry-in path P1 to transport a sheet in the inverse direction. The first switch-back transport path SP1 separates from the sheet carry-in path P1 to the downstream side of the sheet carry-in path P1, the second switch-back transport path SP2 separates from the sheet carry-in path P1 to the upstream side of the sheet carry-in path P1, and the paths SP1 and SP2 are disposed in positions spaced a distance apart from each other (in the horizontal direction in FIG. 2).

Then, a collection tray 29 is disposed on the downstream side of the first switch-back transport path SP1, and the first sheet discharge tray 21 is provided juncturally on the downstream side of the tray 29. Meanwhile, the collection tray 35 is disposed on the downstream side of the second switch-back transport path SP2, and the second sheet discharge tray 22 is provided juncturally on the downstream side of the tray 35.

In such a path configuration, in the sheet carry-in path P1 are disposed a carry-in roller 24 and sheet discharge roller 25, and the rollers are coupled to a driving motor (not shown) capable of rotating forward and backward. Further, in the sheet carry-in path P1 is disposed a path switching piece 27 for guiding a sheet to the second switch-back transport path SP2, and the piece 27 is coupled to an operation means such as a solenoid.

Further, the sheet carry-in path P1 is provided with a buffer guide 26 for temporarily holding a sheet getting to the second switch-back path SP2. In addition, in between the carry-in entrance 23 and carry-in roller 24 is provided a post-processing unit 28 for performing post-processing such as stamping (stamp means) and punching (punch means) on the sheet from the image formation apparatus A.

Configuration of the First Switch-Back Transport Path SP1

The first switch-back transport path SP1 thus disposed on the downstream side (rear end portion of the apparatus) of the sheet carry-in path P1 is configured as described below. The sheet carry-in path P1 is provided at its exit end with the sheet discharge roller 25 and sheet discharge outlet 25*a*. A level difference is formed from the sheet discharge outlet 25*a*, and the collection tray 29 is provided on the downstream side. The collection tray 29 is comprised of a tray for loading and supporting the sheet from the sheet discharge outlet 25*a*.

Above the collection tray 29 is disposed a forward/backward rotation roller 30 capable of moving up and down between a position to come into contact with the sheet on the tray and a spaced standby position (chain-line position in FIG. 3). The forward/backward rotation roller 30 is coupled to a forward/backward rotation motor M1 and is controlled to rotate in a clockwise direction in FIG. 3 when a sheet approaches above the collection tray 29, while rotating in a counterclockwise direction when a sheet rear end approaches above the tray.

Thus, the first switch-back transport path SP1 is configured above the collection tray 29. "31" shown in the figure denotes a transport belt, and its one end portion is brought into press-contact with the sheet discharge roller 25. The transport belt 31 is axially supported pivotably on a pulley shaft 31*a* on the sheet discharge roller 25 side so that the front-end pulley side droops onto the collection tray 29. "30*b*" shown in the figure denotes a driven roller engaging with the forward/backward rotation roller 30, and is provided in the collection tray 29.

By the aforementioned configuration of the first switch-back transport path SP1, the sheet from the sheet discharge outlet 25*a* enters onto the collection tray 29, and is carried out toward the first sheet discharge tray 21 by the forward/backward rotation roller 30, and after the sheet rear end enters onto the collection tray 29 from the sheet discharge outlet 25*a*, the forward/backward rotation roller 30 is rotated backward (in the counterclockwise direction shown in the figure) to move the sheet on the tray in the opposite direction to the sheet discharge direction. At this point, the transport belt 31 works together with the forward/backward rotation roller 30 to transport the sheet rear end toward a rear end regulation member 32 along the collection tray 29.

The rear end regulation member 32 for regulating the position of the sheet rear end and stapling apparatus 33 are disposed in the rear end portion in the sheet discharge direction of the collection tray 29. The stapling apparatus 33 shown in the figure staples one or more portions at the rear end edge of a bunch of sheets collected on the collection tray. Further, the collection tray 29 is provided with a carry-out mechanism for carrying out the stapled sheet bunch to the first sheet discharge tray 21.

The carry-out mechanism shown in the figure is comprised of a grip click 32*a* for griping a bunch of sheets, a driving arm 34*a* for causing the grip click 32*a* to reciprocate from side to side along the collection tray 29, and a sheet discharge motor ME for operating the driving arm 34*a*. Further, the collection tray 29 is provided with side alignment plates 34*b* for aligning the width direction of the sheet collected on the tray, and the side alignment plates 34*b* are comprised of a pair of right and left (front and back in FIG. 3) alignment plates to align the sheet with reference to the center, and are coupled to an alignment motor, not shown, so as to each close and separate from the sheet center.

The first switch-back transport path SP1 configured as described above is to collate sheets from the sheet discharge outlet 25*a* on the collection tray 29 in the "stapling mode" as described previously, and the end face stitching stapling apparatus 33 staples one or more portions at the rear end edge of this bunch of sheets. Further, in the "print-out mode" as described previously, the path SP1 is to transport a sheet from the sheet discharge outlet 25*a* toward the first sheet discharge outlet 21 along the collection tray 29 without switch-back transport. In this way, the apparatus as shown in the figure is characterized in that a sheet to staple is supported in bridge form by the collection tray 29 and the first sheet discharge tray 21 disposed on the downstream side of the tray 29. It is thereby possible to construct a compact apparatus.

Configuration of the Second Switch-Back Transport Path

Described next is a configuration of the second switch-back transport path (sheet discharge path; the same in the following) SP2 separating from the sheet carry-in path P1. As shown in FIG. 3, the second switch-back transport path SP2 is configured to carry a sheet in the substantially vertical direction in the apparatus casing 20, and the sheet discharge rollers 37*a*, 37*b* are disposed in the sheet discharge outlet 36 of the path.

"38" shown in the figure denotes a transport roller for transporting a sheet. Accordingly, it is configured that a sheet carried in from the sheet carry-in transport path P1 is switched backed and transported in the vertical direction from the second switch-back transport path SP2 via the path switching piece 27. The second switch-back transport path SP2 is internally provided with the sheet collecting apparatus as described previously.

A level difference is formed on the downstream side of the sheet discharge outlet 36 of the second switch-back transport path SP2, and the collection tray 35 is disposed therein. The configuration of the collection tray is as described previously.

Configuration of the Regulation Stopper

Figure 4:
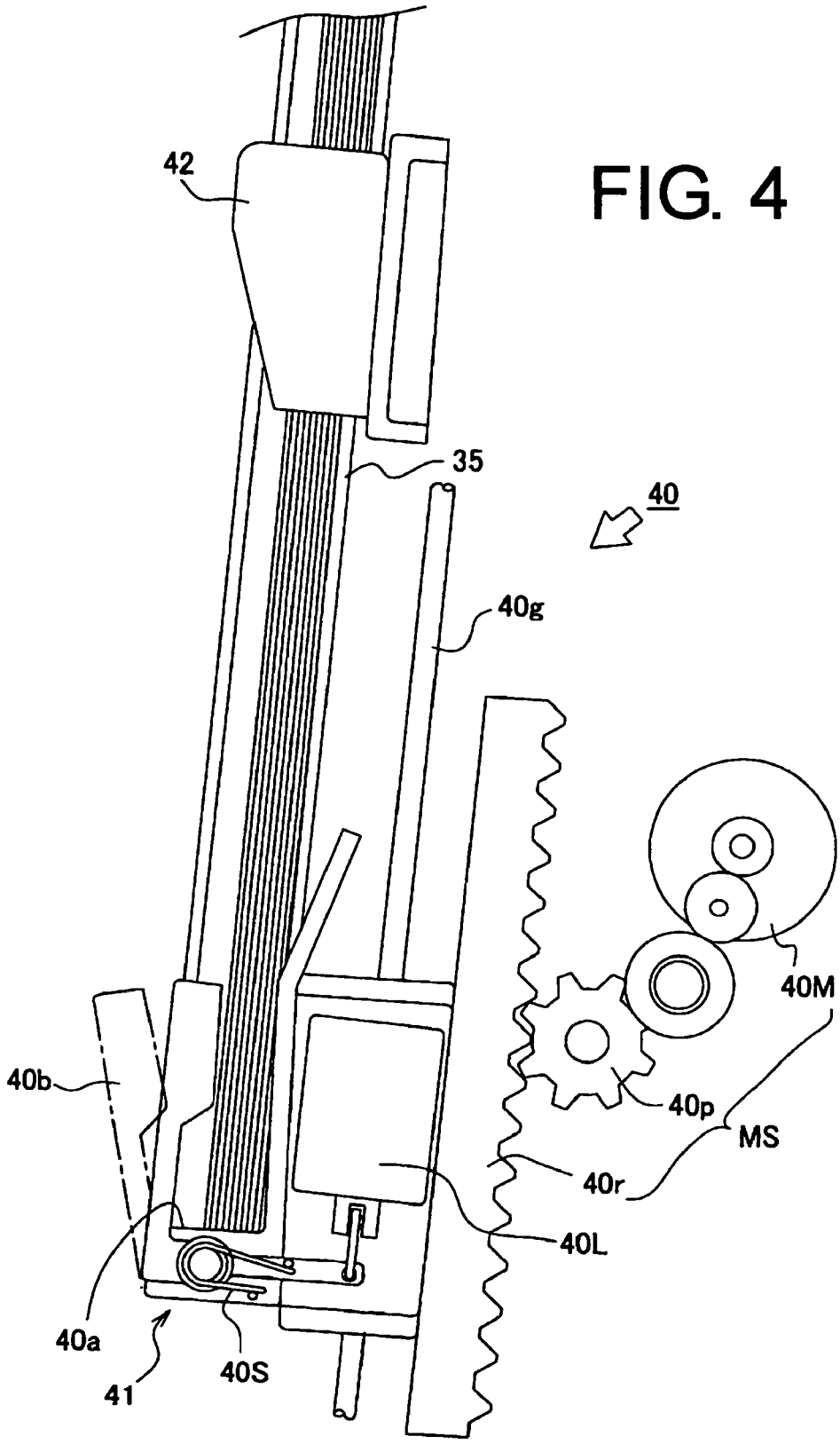
FIG. 4 is an explanatory view illustrating a configuration of a sheet end regulating means in the apparatus of FIG. 2.

In the collection tray 35 is disposed the stopper means 40 for regulating the position of the sheet front end. As shown in FIG. 4, the stopper means 40 is comprised of a locking member 40*a* which the front end of the sheet, which is carried in along the sheet load surface 35*a* of the collection tray 35, strikes and is locked in, and a grip member 40*b* for gripping a bunch of sheets loaded and supported in the locking member 40*a*. The grip member 40*b* is axially supported by the locking member 40*a*, and is configured to grip and hold the sheet front end portion which is regulated in position by the locking member.

Then, the grip member 40*b* is coupled to an operation solenoid 40L and biasing spring 40S, the biasing spring 40S always acts in the grip release direction of the sheet, and when power is applied to the solenoid 40L, the grip member 40*b* grips and holds the sheets.

The stopper means 40 configured as described above is attached to the apparatus frame to be able to travel to positions along the collection tray 35. "40*g*" shown in the figure denotes a guide rail, and the guide rail 40*g* supports a front end regulation unit comprised of the locking member 40*a*, grip member 40*b* and operation solenoid 40L to enable the unit to travel along the collection tray 35. Then, the front end regulation unit is coupled to a shift motor 40M via a rack 40*r* and pinion 40*p*. Accordingly, the shift motor 40M constitutes the shift means MS for shifting the grip member 40*b* and locking member 40*a* along the collection tray 35.

The shift means MS shifts the locking member 40*a*, against which the sheet front end strikes and is regulated when the sheet is carried into the collection tray 35, to positions along the collection tray 35 corresponding to the sheet size, and the sheet rear end is positioned in the rear end regulation position y2 below the sheet discharge outlet 36. In other words, the shift means MS shifts the position of the stopper means 40 corresponding to a sheet size signal, so that the sheet rear end is aligned in the rear end regulation position y2 below the sheet discharge outlet 36. Further, after the sheets are collected on the collection tray 35, the shift means MS shifts a bunch of sheets to a stapling position X, and then to a folding position Y. At this point, the grip member 40*b* moves while gripping the bunch of sheets.

In the collection tray 35 is disposed a saddle-stitching stapling means 39 for stapling a bunch of sheets that are collected and collated. In the collection tray 35 as shown in the figure, the stapling position X is set on the upstream side, and the folding position Y is set on the downstream side.

In the folding position Y disposed on the downstream side of the saddle-stitching stapling apparatus 39 are provided a folding roll means 47 for folding a bunch of sheets, and a folding blade (folding blade means) 48 for inserting the bunch of sheets into a nip position of the folding roll means 47. The folding roll means 47 is comprised of folding rolls 47*a*, 47*b* coming into press-contact with each other, and each of the rolls is formed in a substantially wide length of the maximum sheet.

In addition, this application claims priority from Japanese Patent Application No. 2009-200200 incorporated herein by reference.

What is claimed is:

1. A sheet collecting apparatus comprising:

a sheet discharge outlet for sequentially carrying out a sheet;

sheet collecting means disposed in a level difference formed on a downstream side of the sheet discharge outlet to load and store the sheet from the sheet discharge outlet;

stopper means for regulating a front end position of the sheet to be loaded on the sheet collecting means;

stopper driving means for shifting a position of the stopper means corresponding to a sheet length; and a carry-in guide member for guiding the sheet from the sheet discharge outlet onto an uppermost sheet collected on the sheet collecting means, wherein the carry-in guide member is comprised of a pivot point, a slide-contact guide surface that swings on the pivot point corresponding to a load amount of the sheet collecting means to guide a sheet front end fed from the sheet discharge outlet onto the uppermost sheet, and a sheet pressing portion that is continued to the slide-contact guide surface and that presses the uppermost sheet on the sheet collecting means, in the carry-in guide member are arranged the slide-contact guide surface and the sheet pressing portion in this order in a sheet discharge direction from the sheet discharge outlet, and the stopper means regulates a front end position of the sheet so that a contact point, where the front end of the sheet fed from the sheet discharge outlet first comes into contact with the slide-contact guide surface, is positioned on the downstream side in the sheet discharge direction from a rear end of the sheet loaded on the sheet collecting means, the carry-in guide member is provided with biasing member for causing a pressing force for the sheet pressing portion to press the sheet on the sheet collecting means, and the biasing means is configured to enable a sheet pressing force of the sheet pressing portion to be adjusted to increase or decrease, and the biasing member is comprised of a spring member or a weight member to provide the carry-in guide member with a rotation force on the pivot point, and is coupled to the carry-in guide member via switching means for enabling the biasing member to be engaged to or released from the carry-in guide member.

2. The sheet collecting apparatus according to claim 1, wherein in the carry-in guide member, the sheet pressing portion, the slide-contact guide surface and the pivot point are arranged upward in this order in a sheet load height direction of the sheet collecting means, and the contact point where the sheet front end from the sheet discharge outlet first comes into contact with the slide-contact guide surface is configured to be in a position higher than a maximum permissible load height of the sheet collecting means.

3. The sheet collecting apparatus according to claim 1, wherein the switching means is arranged such that the biasing member engages to or release from the carry-in guide member corresponding to a sheet thickness, material and a curling amount of the sheet carried out of the sheet discharge outlet.

4. The sheet collecting apparatus according to claim 1, wherein the switching means is configured to add the rotation force by the biasing member until the sheet front end from the sheet discharge outlet comes into contact with the slide-contact guide surface, and subsequently, not to add the rotation force by the biasing means.

5. A sheet collecting apparatus comprising:

a sheet discharge outlet for sequentially carrying out a sheet;

sheet collecting means disposed in a level difference formed on a downstream side of the sheet discharge outlet to load and store the sheet from the sheet discharge outlet;

stopper means for regulating a front end position of the sheet to be loaded on the sheet collecting means;

stopper driving means for shifting a position of the stopper means corresponding to a sheet length; and a carry-in guide member for guiding the sheet from the sheet discharge outlet onto an uppermost sheet collected on the sheet collecting means, wherein the carry-in guide member is comprised of a pivot point, a slide-contact guide surface that swings on the pivot point corresponding to a load amount of the sheet collecting means to guide a sheet front end fed from the sheet discharge outlet onto the uppermost sheet, and a sheet pressing portion that is continued to the slide-contact guide surface and that presses the uppermost sheet on the sheet collecting means, in the carry-in guide member are arranged the slide-contact guide surface and the sheet pressing portion in this order in a sheet discharge direction from the sheet discharge outlet, the stopper means regulates a front end position of the sheet so that a contact point, where the front end of the sheet fed from the sheet discharge outlet first comes into contact with the slide-contact guide surface, is positioned on the downstream side in the sheet discharge direction from a rear end of the sheet loaded on the sheet collecting means, a plurality of carry-in guide members is spaced for a distance apart from one another in a direction orthogonal to the sheet discharge direction, one group of the plurality of carry-in guide members is provided with biasing means for adding a pressing force for the sheet pressing portion to press the sheet on the sheet collecting means, and the other group of the carry-in guide members is configured so that the sheet pressing portion causes the pressing force for pressing the sheet by own weight of the guide member.

6. The sheet collecting apparatus according to claim 1, wherein a plurality of carry-in guide members is spaced for a distance apart from one another in a direction orthogonal to the sheet discharge direction, a first group of the plurality of carry-in guide members is provided with biasing means for adding a pressing force for the sheet pressing portion to press the sheet on the sheet collecting means, a second group of the carry-in guide members includes a biasing member for adding a pressing force for the sheet pressing portion to press the sheet so as to enable the biasing member to be switched between engagement and release, and the second group is arranged on both sides in a sheet width direction of the first group.

7. An image formation system comprising:

an image formation apparatus for forming an image on a sheet sequentially; and the sheet collecting apparatus for collating and collecting sheets from the image formation apparatus according to claim 1.

* * * * *